US010170050B2

(12) United States Patent
Sun

(10) Patent No.: US 10,170,050 B2
(45) Date of Patent: Jan. 1, 2019

(54) PIXEL CIRCUIT, DRIVING METHOD, ORGANIC ELECTROLUMINESCENT DISPLAY PANEL, AND DISPLAY DEVICE

(71) Applicant: Boe Technology Group Co., Ltd., Beijing (CN)

(72) Inventor: Tuo Sun, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 49 days.

(21) Appl. No.: 15/320,407

(22) PCT Filed: Sep. 18, 2015

(86) PCT No.: PCT/CN2015/089967
§ 371 (c)(1),
(2) Date: Dec. 20, 2016

(87) PCT Pub. No.: WO2016/187991
PCT Pub. Date: Dec. 1, 2016

(65) Prior Publication Data

US 2017/0256202 A1 Sep. 7, 2017

(30) Foreign Application Priority Data

May 28, 2015 (CN) ..... 2015 1 0284618

(51) Int. Cl.
*G09G 3/3258* (2016.01)
*G09G 3/32* (2016.01)
(Continued)

(52) U.S. Cl.
CPC ..... *G09G 3/3258* (2013.01); *G09G 3/32* (2013.01); *G09G 3/3233* (2013.01);
(Continued)

(58) Field of Classification Search
None
See application file for complete search history.

(56) References Cited

U.S. PATENT DOCUMENTS

2010/0220038 A1 9/2010 Chung et al.
2011/0115764 A1 5/2011 Chung
(Continued)

FOREIGN PATENT DOCUMENTS

CN 1735293 2/2006
CN 102254510 11/2011
(Continued)

OTHER PUBLICATIONS

The International Search Report for PCT/CN2015/089967 dated Feb. 14, 2016.
(Continued)

*Primary Examiner* — Kenneth B Lee, Jr.
(74) *Attorney, Agent, or Firm* — Calfee, Halter & Griswold LLP

(57) ABSTRACT

A pixel circuit, a driving method, an organic electroluminescent display panel, and a display device are provided. The pixel circuit comprises a driving controller, a light emitter, a light emitting controller, an initialization controller, and a compensation controller. The pixel circuit can compensate the drift of the threshold voltage of the driving controller by using the preset threshold voltage which is written by the compensation controller and has a same threshold voltage as the driving controller. The driving current by which the driving controller drives the light emitter to emit light is only dependent on the voltage of the data signal and the voltage of the initialization signal, and independent on the threshold voltage of the driving controller, thus preventing the threshold voltage of the driving controller from affecting the light emitter.

18 Claims, 6 Drawing Sheets

(51) Int. Cl.
*G09G 3/3266* (2016.01)
*G09G 3/3291* (2016.01)
*G09G 3/3233* (2016.01)

(52) U.S. Cl.
CPC ..... *G09G 3/3266* (2013.01); *G09G 3/3291* (2013.01); *G09G 2300/043* (2013.01); *G09G 2300/0809* (2013.01); *G09G 2320/0233* (2013.01); *G09G 2320/0646* (2013.01)

(56) References Cited

U.S. PATENT DOCUMENTS

2015/0317932 A1* 11/2015 Zhou ..... G09G 3/32
345/173
2016/0125801 A1* 5/2016 Chung ..... G09G 3/3233
345/78

FOREIGN PATENT DOCUMENTS

| | | |
|---|---|---|
| CN | 103413522 | 11/2013 |
| CN | 203882588 | 10/2014 |
| CN | 104835453 | 8/2015 |
| KR | 20140056697 | 5/2014 |

OTHER PUBLICATIONS

Office Action from China Application No. 201510284618.X dated Oct. 10, 2016.

* cited by examiner

PIXEL CIRCUIT, DRIVING METHOD, ORGANIC ELECTROLUMINESCENT DISPLAY PANEL, AND DISPLAY DEVICE

RELATED APPLICATIONS

The present application is the U.S. national phase entry of PCT/CN2015/089967, with an international filing date of Sep. 18, 2015, which claims the benefit of Chinese Patent Application No. 201510284618.X, filed on May 28, 2015, the entire disclosures of which are incorporated herein by reference.

TECHNICAL FIELD

The present invention relates to the field of organic electroluminescence technique, and particularly to a pixel circuit, a driving method, an organic electroluminescent display panel, and a display device.

BACKGROUND

Organic light emitting diodes (OLEDs) are among the research focuses in the display field. As compared with liquid crystal displays (LCDs), OLEDs have advantages of low energy consumption, low production cost, self-light emitting, wide viewing angles, and fast response. Currently, OLED display screens start to replace conventional LCD display screens in fields like mobile phones, PDAs, digital cameras. Design of a pixel circuit is one of the core techniques of the OLED display device, and has important research significance.

The brightness of LCDs is controlled by a stable voltage, while OLEDs are driven by a current, and a stable current is required to control light emitting. Due to process factors and device aging, driving transistors in the pixel circuit are non-uniform in the threshold voltage $V_{th}$. As a result, different currents flow through different pixels in the OLED, so that these pixels are not uniform in brightness, which affects the display effect of the whole image.

An existing 2T1C pixel circuit is shown in FIG. 1. The pixel circuit consists of one driving transistor T2, one switch transistor T1 and one storage capacitor Cs. When a scan line SL selects a row, the scan line SL inputs a low level signal, so that the P-type switch transistor T1 turns on, and a voltage of a data line DL is written into the storage capacitor Cs. After the row is scanned, the signal input by scan line SL changes to a high level, the P-type switch transistor T1 is cut off, and the voltage stored in the storage capacitor Cs controls the driving transistor T2 to produce a current for driving OLED pixels, which ensures the OLED pixels emit light continuously in a frame. The driving transistor T2 has a saturation current $I_{OLED}=K(V_{SG}-V_{th})^2$, wherein $V_{SG}$ is a voltage difference between a source and a gate of the driving transistor T2, K is a structural parameter, and $V_{th}$ is a threshold voltage of the driving transistor T2. As mentioned above, the threshold voltage $V_{th}$ of the driving transistor T2 may drift due to process factors and device aging. As a result, currents flowing through different pixels in the OLED vary with the variation of the threshold voltage $V_{th}$ of the driving transistor, which leads to non-uniform image brightness.

SUMMARY

Therefore, embodiments of the present invention provide a pixel circuit, comprising a driving controller, a light emitter, a light emitting controller, an initialization controller, and a compensation controller, wherein the driving controller is configured to supply a driving current to the light emitter for driving the light emitter to emit light;

wherein in an initialization phase, the initialization controller is configured to, under the control of an initialization control signal, supply an initialization signal to the driving controller;

wherein in the compensation phase, the compensation controller is configured to, under the control of a compensation control signal and a data signal, write the data signal and a preset threshold voltage into the driving controller, wherein the preset threshold voltage has a same threshold voltage as the driving controller to compensate the drift of the threshold voltage of the driving controller; and wherein in a light emitting phase, the light emitting controller is configured to, under the control of a light emitting control signal, supply a voltage of a first reference voltage line to an input terminal of the driving controller, store the data signal and the preset threshold voltage in another input terminal of the driving controller, and apply the driving current from the driving controller to the light emitter for driving the light emitter to emit light.

In a possible implementation, in an embodiment of the pixel circuit, the driving controller comprises a first input terminal which is connected with an output terminal of the initialization controller; a second input terminal which is connected with an output terminal of the compensation controller and a first output terminal of the light emitting controller; a third input terminal which is connected with a first input terminal of the light emitting controller and the first reference voltage line; and an output terminal which is connected with a second input terminal of the light emitting controller;

the initialization controller comprises a control terminal which is configured to receive the initialization control signal; an input terminal which is configured to receive the initialization signal; and an output terminal which is connected with the first input terminal of the driving controller;

the compensation controller comprises a first control terminal which is configured to receive the compensation control signal; a second control terminal which is configured to receive the data signal; an output terminal which is connected with the second input terminal of the driving controller and the first output terminal of the light emitting controller; and an input terminal which is connected with a second reference voltage line;

the light emitting controller comprises a first input terminal which is connected with the third input terminal of the driving controller and the first reference voltage line; a control terminal which is configured to receive the light emitting control signal; the second input terminal which is connected with an output terminal of the driving controller; the first output terminal which is connected with the second input terminal of the driving controller and the output terminal of the compensation controller; and a second output terminal which is connected with a terminal of the light emitter, and the other terminal of the light emitter is connected with a third reference voltage line.

In a possible implementation, in an embodiment of the pixel circuit, in the light emitting phase, the light emitting controller is configured to, under the control of the light emitting control signal, supply the voltage of the first reference voltage line to the second input terminal of the driving controller, and store the data signal and the preset threshold voltage in the first input terminal of the driving controller.

In a possible implementation, in an embodiment of the pixel circuit, the driving controller comprises a first driving transistor and capacitor, wherein the first driving transistor comprises a gate, which is the first input terminal of the driving controller; a source, which is the third input terminal of the driving controller; and a drain, which is the output terminal of the driving controller, and the first driving transistor has a threshold voltage equal to that of the driving controller; and wherein the capacitor comprises a first terminal which is connected with the gate of the first driving transistor, and a second terminal which is the second input terminal of the driving controller.

In a possible implementation, in an embodiment of the pixel circuit, the initialization controller comprises a first switch transistor, wherein the first switch transistor comprises a gate, which is the control terminal of the initialization controller; a source, which is the input terminal of the initialization controller; and a drain, which is the output terminal of the initialization controller.

In a possible implementation, in an embodiment of the pixel circuit, the compensation controller comprises a second switch transistor and a second driving transistor, wherein the second switch transistor comprises a gate, which is the first control terminal of the compensation controller; a drain, which is the input terminal of the compensation controller; and a source which is connected with the drain of the second driving transistor; and wherein the second driving transistor comprises a gate, which is the second control terminal of the compensation controller; and a source, which is the output terminal of the compensation controller, wherein the second driving transistor has a threshold voltage equal to the preset threshold voltage.

For example, in an embodiment of the pixel circuit, the second driving transistor has a size and shape identical to that of the first driving transistor.

For example, in an embodiment of the pixel circuit, the second driving transistor is arranged close to the first driving transistor.

In a possible implementation, in an embodiment of the pixel circuit, the light emitting controller comprises a third switch transistor and a fourth switch transistor, wherein the third switch transistor comprises a gate, which is the control terminal of the light emitting controller; a source, which is the first input terminal of the light emitting controller; and a drain, which is the first output terminal of the light emitting controller; and wherein the fourth switch transistor comprises a gate, which is the control terminal of the light emitting controller; a source, which is the second input terminal of the light emitting controller; and a drain, which is the second output terminal of the light emitting controller.

For example, to simplify the fabricating process, in an embodiment of the pixel circuit, the first, second, third and fourth switch transistors are N-type transistors or P-type transistors.

Accordingly, an embodiment of the present invention further provides a method for driving the above pixel circuit, comprising:

in the initialization phase, by means of the initialization controller which is under the control of the initialization control signal, supplying the initialization signal to the first input terminal of the driving controller;

in the compensation phase, by means of the compensation controller which is under the control of the compensation control signal and the data signal, writing the data signal and the preset threshold voltage into the second input terminal of the driving controller; wherein the preset threshold voltage has a same threshold voltage as the driving controller;

in the light emitting phase, by means of the light emitting controller which is under the control of the light emitting control signal, supplying the voltage of the first reference voltage line to the second input terminal of the driving controller, storing the data signal and the preset threshold voltage in the first input terminal of the driving controller, and outputting the driving current from the driving controller to the light emitter for driving the light emitter to emit light.

Accordingly, an embodiment of the present invention further provides a organic electroluminescent display panel, which comprises any pixel circuit in the above embodiments.

Accordingly, an embodiment of the present invention further provides a display device, which comprises any organic electroluminescent display panel in the above embodiments of the present invention.

DETAILED DESCRIPTION OF EMBODIMENTS

The pixel circuit, the driving method, the organic electroluminescent display panel, and the display device will be further described in the following text with reference to figures and embodiments.

Figure 1:
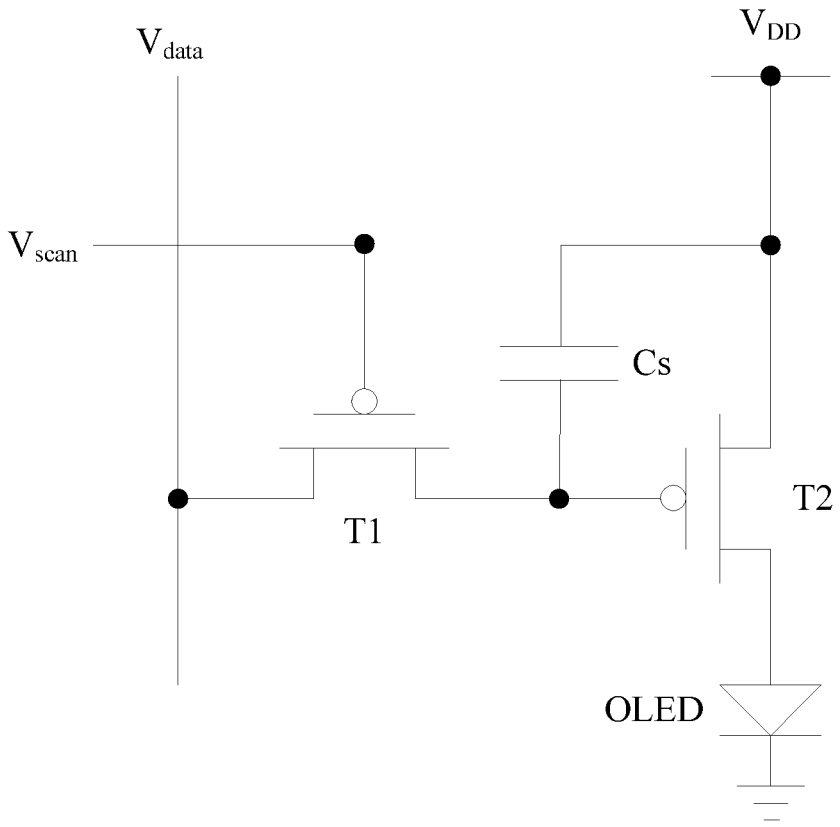
FIG. 1 is a structural view illustrating a pixel circuit of an existing 2T1C.
Figure 2:
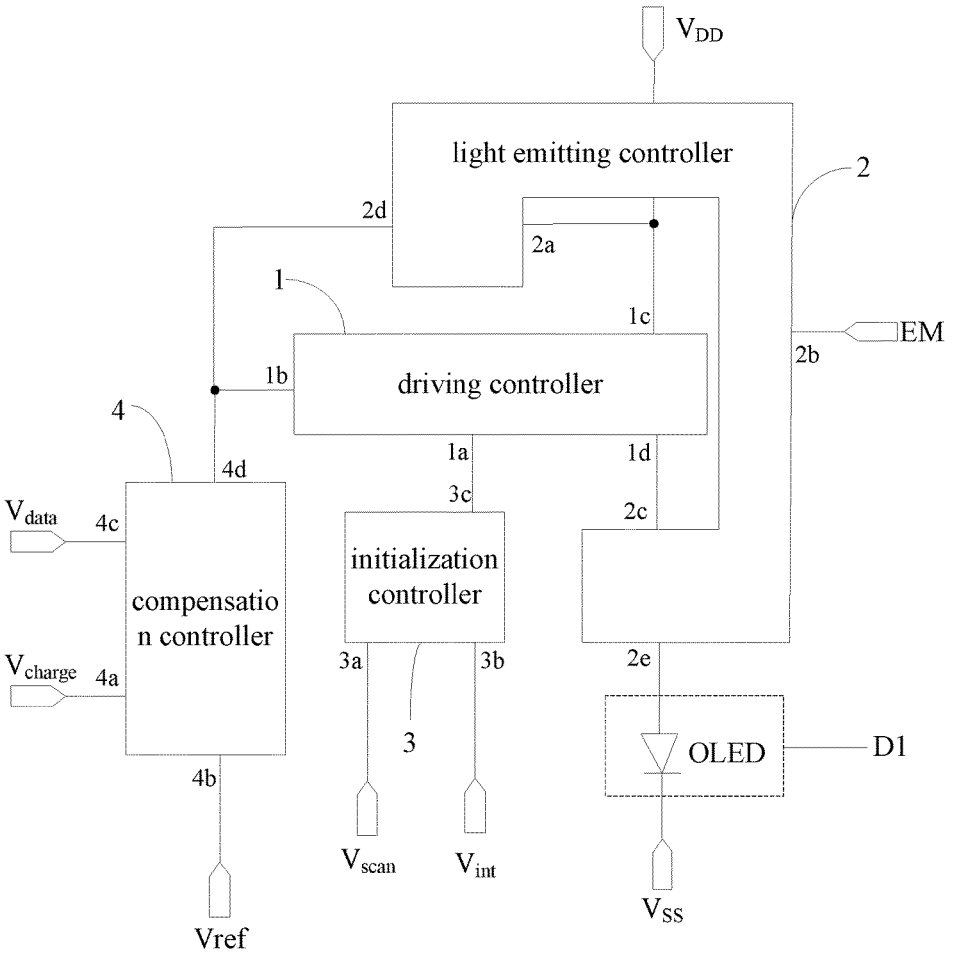
FIG. 2 is a structural view illustrating a pixel circuit in an embodiment of the present invention.

In an embodiment of the present invention, as shown in FIG. 2, a pixel circuit comprises a driving controller 1, a light emitter D1, a light emitting controller 2, an initialization controller 3, and a compensation controller 4.

The driving controller 1 comprises a first input terminal 1*a,* which is connected with an output terminal 3*c* of the initialization controller 3; a second input terminal 1*b,* which is connected with an output terminal 4*d* of the compensation controller 4 and a first output terminal 2*d* of the light emitting controller 2; a third input terminal 1*c,* which is connected with a first input terminal 2*a* of the light emitting controller 2 and a first reference voltage line VDD; and an output terminal 1*d*, which is connected with a second input terminal 2*c* of the light emitting controller 2. The driving controller 1 is configured to supply a driving current to the light emitter D1 for driving the light emitter D1 to emit light.

The initialization controller 3 comprises a control terminal 3*a* for receiving an initialization control signal $V_{scan}$; an input terminal 3*b* for receiving an initialization signal $V_{int}$; and the output terminal 3*c* which is connected with the first input terminal 1*a* of the driving controller 1. The initialization controller 3 is configured to, under the control of the initialization control signal $V_{scan}$, supply the initialization signal $V_{int}$ to the first input terminal 1*a* of the driving controller 1.

The compensation controller 4 comprises a first control terminal 4*a* for receiving a compensation control signal $V_{charge}$; a second control terminal 4*c* for receiving a data signal $V_{data}$; the output terminal 4*d* which is connected with the second input terminal 1*b* of the driving controller 1; and an input terminal 4*b* which is connected with a second reference voltage line Vref. The compensation controller 4 is configured to, under the control of the compensation control signal $V_{charge}$ and the data signal $V_{data}$, write the data signal Vdata and a preset threshold voltage into the second input terminal 1*b* of the driving controller 1. The preset threshold voltage and the driving controller 1 have a same threshold voltage.

The light emitting controller 2 comprises the first input terminal 2*a* which is connected with the third input terminal 1*c* of the driving controller 1 and the first reference voltage line VDD; a control terminal 2*b* for receiving a light emitting control signal EM; the second input terminal 2*c* which is connected with the output terminal 1*d* of the driving controller 1; the first output terminal 2*d* which is connected with the second input terminal 1*b* of the driving controller 1 and the output terminal 4*d* of the compensation controller 4; and a second output terminal 2*e* which is connected with a terminal of the light emitter D1. The other terminal of the light emitter D1 is connected with a third reference voltage line VSS. The light emitting controller 2 is configured to, under the control of the light emitting control signal EM, supply a voltage $V_{DD}$ of the first reference voltage line VDD to the second input terminal 1*b* of the driving controller 1, store the data signal $V_{data}$ and the preset threshold voltage in the first input terminal 1*a* of the driving controller 1, and output a driving current from the driving controller 1 to the light emitter D1 for driving the light emitter D1 to emit light.

In an embodiment of the present invention, the pixel circuit comprises the driving controller, the light emitter, the light emitting controller, the initialization controller, and the compensation controller. These modules cooperate with one another, and by using the preset threshold voltage which is written by the compensation controller and has a same threshold voltage as the driving controller, the pixel circuit can compensate the drift of the threshold voltage of the driving controller. Therefore, during emitting light to display, the driving current by which the driving controller drives the light emitter to emit light is only dependent on the voltage of the data signal and the voltage of the initialization signal, and independent on the threshold voltage of the driving controller, thus preventing the threshold voltage of the driving controller from affecting the light emitter. In other words, when different pixel units are supplied with an identical data signal, images of identical brightness can be obtained, which improves uniformity of image brightness in the display region of the display device.

The specific embodiments of the present invention shall be further described hereinafter. The following embodiments are only used for explaining more clearly the technical solution of the present invention rather than limiting the protection scope of the present invention.

Figure 3A:
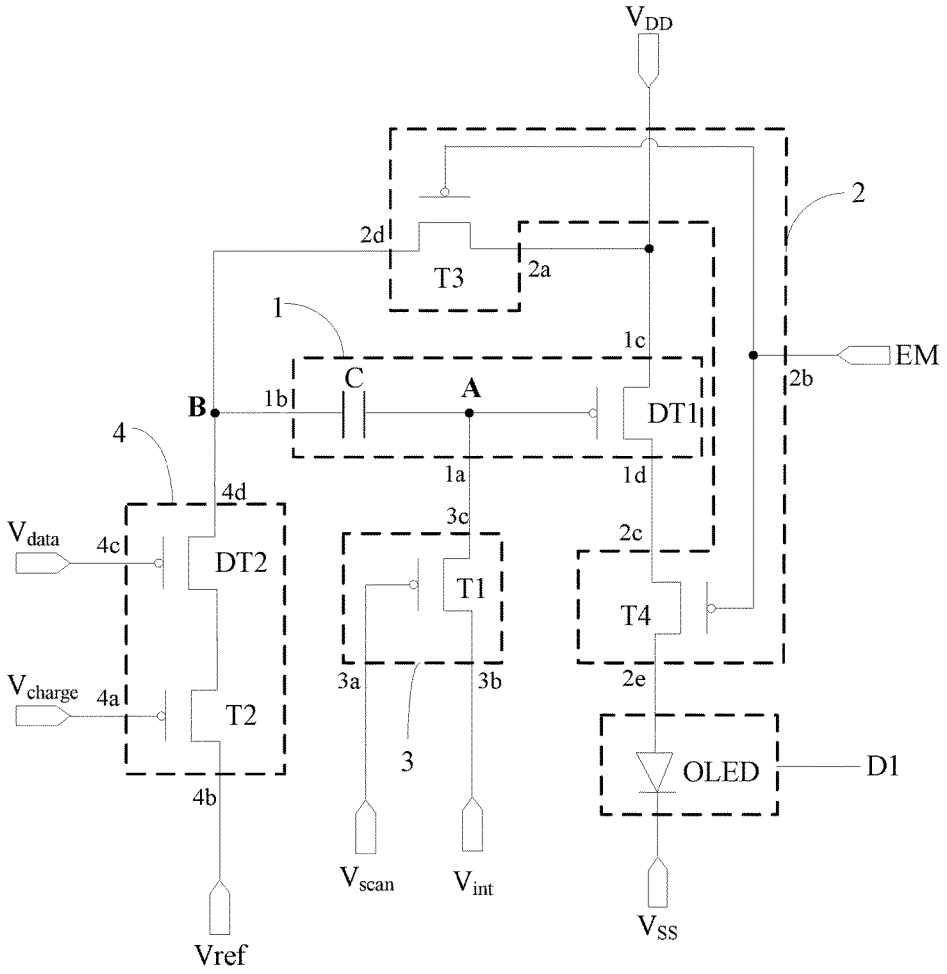
FIG. 3*a* is a structural view illustrating a specific pixel circuit in an embodiment of the present invention.
Figure 3B:
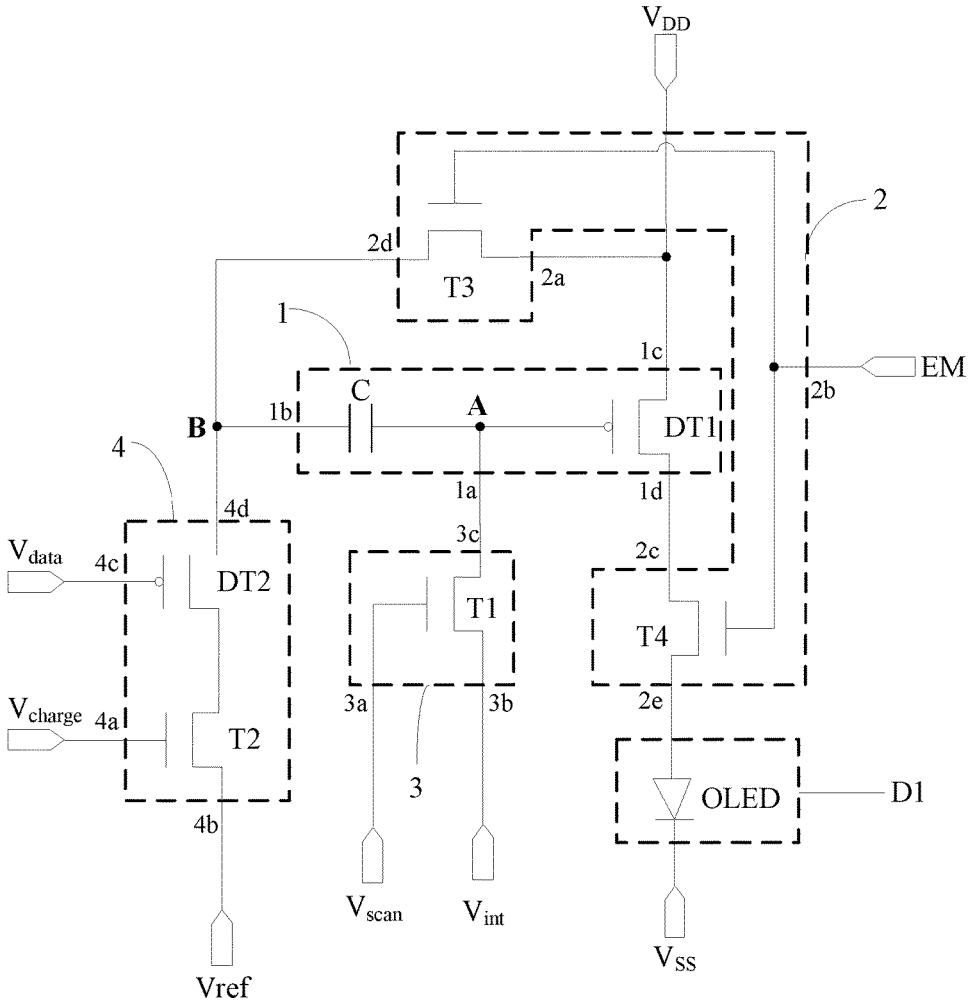
FIG. 3*b* is a structural view illustrating another specific pixel circuit in an embodiment of the present invention.

For example, in an embodiment of the pixel circuit, as shown in FIG. 3*a* and FIG. 3*b*, the driving controller 1 specifically comprises a first driving transistor DT1 and a capacitor C.

The first driving transistor DT1 comprises a gate, which is the first input terminal 1*a* of the driving controller 1; a source, which is the third input terminal 1*c* of the driving controller 1; and a drain, which is the output terminal 1*d* of the driving controller 1. The first driving transistor DT1 has a threshold voltage $V_{th1}$ equal to the threshold voltage of the driving controller 1.

The capacitor C comprises a first terminal which is connected with the gate of the first driving transistor DT1, and a second terminal which is the second input terminal 1*b* of the driving controller 1.

During implementation, in an embodiment of the pixel circuit, the first driving transistor DT1 is generally a P-type transistor. Since the P-type transistor has a threshold voltage of a negative value, in order to ensure normal operation of the first driving transistor DT1, the voltage $V_{DD}$ of the first reference voltage line VDD is generally a positive voltage, and the voltage $V_{SS}$ of the third reference voltage line VSS is generally a ground potential or a negative value.

Furthermore, during implementation, in an embodiment of the pixel circuit, the light emitter D1 is generally an OLED. As shown in FIGS. 3*a* and 3*b*, an anode of the OLED is connected with the second output terminal 2*e* of the light emitting controller 2, a cathode of the OLED is connected with the third reference voltage line VSS, and the OLED emits light for displaying under a saturation current of the first driving transistor DT1 .

For example, in an embodiment of the pixel circuit, as shown in FIG. 3*a* and FIG. 3*b*, the initialization controller 3 can specifically comprise a first switch transistor T1.

The first switch transistor T1 comprises a gate, which is the control terminal 3*a* of the initialization controller 3; a source, which is the input terminal 3*b* of the initialization controller 3; and a drain, which is the output terminal 3*c* of the initialization controller 3.

Furthermore, during implementation, as shown in FIG. 3*a*, the first switch transistor T1 can be a P-type transistor. In this case, when the initialization control signal $V_{scan}$ is a low level, the first switch transistor T1 is in an on-state, and when the initialization control signal $V_{scan}$ is a high level, the first switch transistor T1 is in an off-state. Alternatively, as shown in FIG. 3*b*, the first switch transistor T1 can also be a N type transistor. In this case, when the initialization control signal $V_{scan}$ is a high level, the first switch transistor T1 is in the on-state, and when the initialization control signal $V_{scan}$ is a low level, the first switch transistor T1 is in the off-state. The present invention is not limited in term of the type of the first switch transistor T1.

In particular, in an embodiment of the pixel circuit, when the first switch transistor is in the on-state under the control of the initialization control signal, the initialization signal is transferred to the first input terminal of the driving controller via the first switch transistor in the on-state, so that a function of initializing the first input terminal of the driving controller is realized.

In the foregoing, the structure of the initialization controller in the pixel circuit is described in an exemplary manner. During implementation, the initialization controller is not limited to the structure as described above, but can have other structures which are known for a person with ordinary skill in the art.

For example, in an embodiment of the pixel circuit, as shown in FIG. 3*a* and FIG. 3*b*, the compensation controller 4 can specifically comprise a second switch transistor T2 and a second driving transistor DT2.

The second switch transistor T2 comprises a gate, which is the first control terminal 4*a* of the compensation controller 4; a drain, which is the input terminal 4*b* of the compensation controller 4; and a source which is connected with the drain of the second driving transistor DT2.

The second driving transistor DT2 comprises a gate, which is the second control terminal 4*c* of the compensation controller 4; and a source, which is the output terminal 4*d* of the compensation controller 4. The second driving transistor DT2 has a threshold voltage $V_{th2}$ which is a preset threshold voltage. Namely, the second driving transistor DT2 has the threshold voltage $V_{th2}$ which is equal to the threshold voltage $V_{th1}$ of the first driving transistor DT1.

Furthermore, during implementation, since the first driving transistor DT1 is generally a P-type transistor, and the threshold voltage $V_{th2}$ of the second driving transistor DT2 equals to the threshold voltage $V_{th1}$ of the first driving transistor DT1, the second driving transistor DT2 and the first driving transistor DT1 are of a same polarity. Therefore, the second driving transistor generally is also a P-type transistor.

For example, during implementation, the second driving transistor DT2 has a same size and shape as the size and shape of the first driving transistor DT1, and the second driving transistor DT2 is arranged close to the first driving transistor DT1, so that the threshold voltage $V_{th2}$ of the second driving transistor DT2 equals to the threshold voltage $V_{th1}$ of the first driving transistor DT1. In this way, the threshold voltage $V_{th2}$ of the second driving transistor DT2 is made equal to the threshold voltage $V_{th1}$ of the first driving transistor DT1 by decreasing process difference.

Furthermore, during implementation, as shown in FIG. 3*a*, the second switch transistor T2 can be a P-type transistor. In this case, when the compensation control signal $V_{charge}$ is a low level, the second switch transistor T2 is in the on-state, and when the compensation control signal $V_{charge}$ is a high level, the second switch transistor T2 is in the off-state. Alternatively, as shown in FIG. 3*b*, the second switch transistor T2 can also be a N type transistor. In this case, when the compensation control signal $V_{charge}$ is a high level, the second switch transistor T2 is in the on-state, and when the compensation control signal $V_{charge}$ is a low level, the second switch transistor T2 is in the off-state. The present invention is not limited in term of the type of the second switch transistor T2.

In particular, in an embodiment of the pixel circuit, when the second switch transistor T2 is in the on-state under the control of the compensation control signal $V_{discharge}$, and the second driving transistor DT2 is in the on-state under the control of the data signal $V_{data}$, the driving controller 1 starts to discharge, until the source voltage of the second driving transistor DT2 is $V_{data}-V_{th2}$. The second driving transistor DT2 is in a subthreshold state, and the source voltage of the second driving transistor DT2 is kept at $V_{data}-V_{th2}$, so that a function of writing the voltage of the data signal $V_{data}$ and $V_{th2}$ into the second input terminal 1*b* of the driving controller 1 is realized.

In the foregoing, the structure of the compensation controller in the pixel circuit is described in an exemplary manner. During implementation, the compensation controller is not limited to the structure as described above, but can have other structures which are known for the person with ordinary skill in the art.

For example, in an embodiment of the pixel circuit, as shown in FIG. 3*a* and FIG. 3*b*, the light emitting controller 2 can specifically comprise a third switch transistor T3 and a fourth switch transistor T4.

The third switch transistor T3 comprises a gate, which is the control terminal 2*b* of the light emitting controller 2; a source, which is the first input terminal 2*a* of the light emitting controller 2; and a drain, which is the first output terminal 2*d* of the light emitting controller 2.

The fourth switch transistor T4 comprises a gate, which is the control terminal 2*b* of the light emitting controller 2; a source, which is the second input terminal 2*c* of the light emitting controller 2; and a drain, which is the second output terminal 2*e* of the light emitting controller.

Furthermore, during implementation, as shown in FIG. 3*a*, the third switch transistor T3 and the fourth switch transistor T4 can be P-type transistors. In this case, when the light emitting control signal EM is a low level, the third switch transistor T3 and the fourth switch transistor T4 are in the on-state, and when the light emitting control signal EM is a high level, the third switch transistor T3 and the fourth switch transistor T4 are in the off-state. Alternatively, as shown in FIG. 3*b*, the third switch transistor T3 and the fourth switch transistor T4 can also be N type transistors. In this case, when the light emitting control signal EM is a high level, the third switch transistor T3 and the fourth switch transistor T4 are in the on-state, and when the light emitting control signal EM is a low level, the third switch transistor T3 and the fourth switch transistor T4 are in the off-state. The present invention is not limited in term of the type of the third switch transistor T3 and the fourth switch transistor T4.

In particular, in an embodiment of the pixel circuit, when the third switch transistor T3 and the fourth switch transistor T4 are in the on-state under the control of the light emitting control signal, the voltage $V_{DD}$ of the first reference voltage line VDD is transferred to the second input terminal 1*b* of the driving controller via the third switch transistor T3 in the on-state. The driving controller 1 stores the data signal $V_{data}$ and the preset threshold voltage $V_{th2}$ in the first input terminal 1*a*. The fourth switch transistor T4 in the on-state outputs the driving current from the driving controller 1 to the light emitter D1, so as to drive the light emitter D1 to emit light.

In the foregoing, the structure of the light emitting controller in the pixel circuit is described in an exemplary manner. During implementation, the light emitting controller is not limited to the structure as described above, but can have other structures which are known for the person with ordinary skill in the art.

It is noted that the driving transistor and the switch transistor in the embodiments can be thin film transistors (TFTs), or metal-oxide semiconductor field effect transistors (MOS-FETs).

For example, in order to simplify the fabricating process, in an embodiment of the pixel circuit, all switch transistors are P-type transistors, or all switch transistors are N-type transistors.

For example, in an embodiment of the pixel circuit, all driving transistors and switch transistors can be P-type transistors, thus simplifying the process for fabricating the pixel circuit.

The operation of a pixel circuit in an embodiment of the present invention will be described hereinafter by taking the pixel circuit shown in FIG. 3*a* and FIG. 3*b* as an example. Only for purpose of ease of description, it is defined that the first input terminal 1*a* of the driving controller 1 is a first node A, and the second input terminal 1*b* of the driving controller 1 is a second node B. In the following description, 1 indicates a high level signal, and 0 indicates a low level signal.

Example 1

Figure 4A:
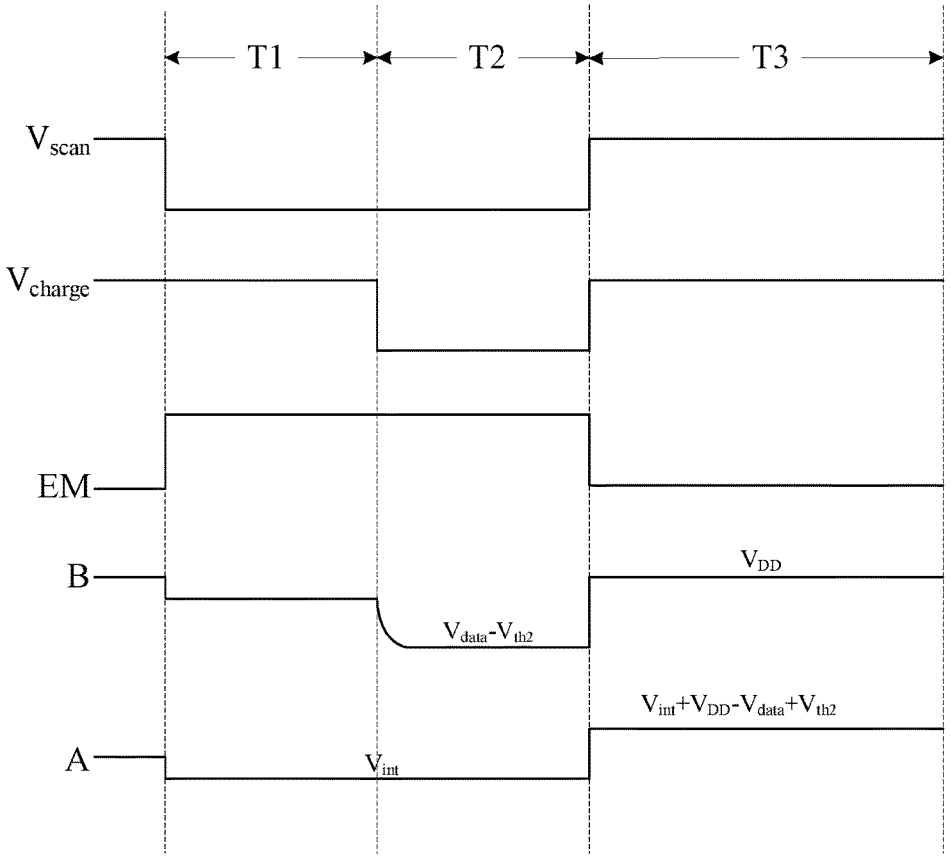
FIG. 4*a* is a circuit timing diagram for the pixel circuit of FIG. 3*a;*

The operation of the pixel circuit is described by taking the pixel circuit shown in FIG. 3*a* as an example. In the pixel circuit shown in FIG. 3*a*, the first driving transistor DT1 and the second driving transistor DT2 are P-type transistors, and all switch transistors are P-type transistors. Each of the P-type transistors is cut off under the high level, and turns on under the low level. The corresponding input timing diagram is shown in FIG. 4*a*. In particular, three phases T1, T2, and T3 in the input timing diagram shown in FIG. 4*a* are selected.

In the phase T1, $V_{scan}=0$, $V_{charge}=1$, and EM=1. Accordingly, the first switch transistor T1 is in the on-state, while the second switch transistor T2, the third switch transistor T3 and the fourth switch transistor T4 are in the off-state. The initialization signal $V_{int}$ is supplied to the first node A via the first switch transistor T1 in the on-state. Therefore, in this phase, a voltage of the first node A is $V_{int}$, and a voltage of the second node B decreases as the voltage of the first node A decreases.

In the phase T2, $V_{scan}=0$, $V_{charge}=0$, and EM=1. Accordingly, the first switch transistor T1 and the second switch transistor T2 are in the on-state, while the third switch transistor T3 and the fourth switch transistor T4 are in the off-state. The initialization signal $V_{int}$ is supplied to the first node A via the first switch transistor T1 in the on-state. Since the second switch transistor T2 turns on, the capacitor C starts to dischargevia the second driving transistor DT2. Until the source voltage of the second driving transistor DT2 is $V_{data}-V_{th2}$, i.e., the second driving transistor DT2 is in the subthreshold state, the capacitor C stops discharging. In this phase, the voltage of the first node A is still $V_{int}$, and the voltage of the second node B gradually decreases to $V_{data}-V_{th2}$.

In the phase T3, $V_{scan}=1$, $V_{charge}=1$, and EM=0. The first switch transistor T1 and the second switch transistor T2 are in the off-state, while the third switch transistor T3 and the fourth switch transistor T4 are in the on-state. In this phase, since the third switch transistor T3 turns on, the voltage of the second node B changes from $V_{data}-V_{th2}$ in the previous phase to the voltage $V_{DD}$ of the first reference voltage line VDD. According to the principle of charge conservation in the capacitor, the voltage of the first node A changes from $V_{int}$ in the previous phase to $V_{int}+V_{DD}-(V_{data}-V_{th2})$. Therefore, in this phase, the gate of the first driving transistor DT1 has a voltage which is kept at $V_{int}+V_{DD}-(V_{data}-V_{th2})$, the source voltage of the first driving transistor DT1 is $V_{DD}$, and the first driving transistor DT1 operates in the saturation state. According to the saturation state current characteristics, the operating current $I_{OLED}$ which runs through the first driving transistor DT1 and drives the OLED to emit light satisfies the following formula: $I_{OLED}=K(V_{gs}-V_{th1})^2=K[V_{int}+V_{DD}-(V_{data}-V_{th2})-V_{DD}-V_{th1}]^2=K(V_{int}-V_{data}+V_{th2}-V_{th1})^2$, wherein K is a structural parameter. K has a relatively stable value in identical structures, and thus can be deemed as a constant. Since the threshold voltage V of the second driving transistor DT2 equals to the threshold voltage $V_{th1}$ of the first driving transistor DT1, the operating current $I_{OLED}=K(V_{int}-V_{data})^2$. As can be seen, the operating current $I_{OLED}$ of the OLED is no longer affected by the threshold voltage $V_{th1}$ of the first driving transistor DT1, and is independent from the voltage $V_{DD}$ of the first reference voltage line VDD and only dependent on the voltage of the data signal $V_{data}$ and the initialization signal $V_{int}$. Therefore, the effect of the drift and IR drop of the threshold voltage $V_{th1}$ of the first driving transistor DT1 (due to process factors and long-time operation) on the operating current $I_{OLED}$ of the light emitter D1 is completely eliminated, which decreases non-uniformity of panel display.

Example 2

Figure 4B:
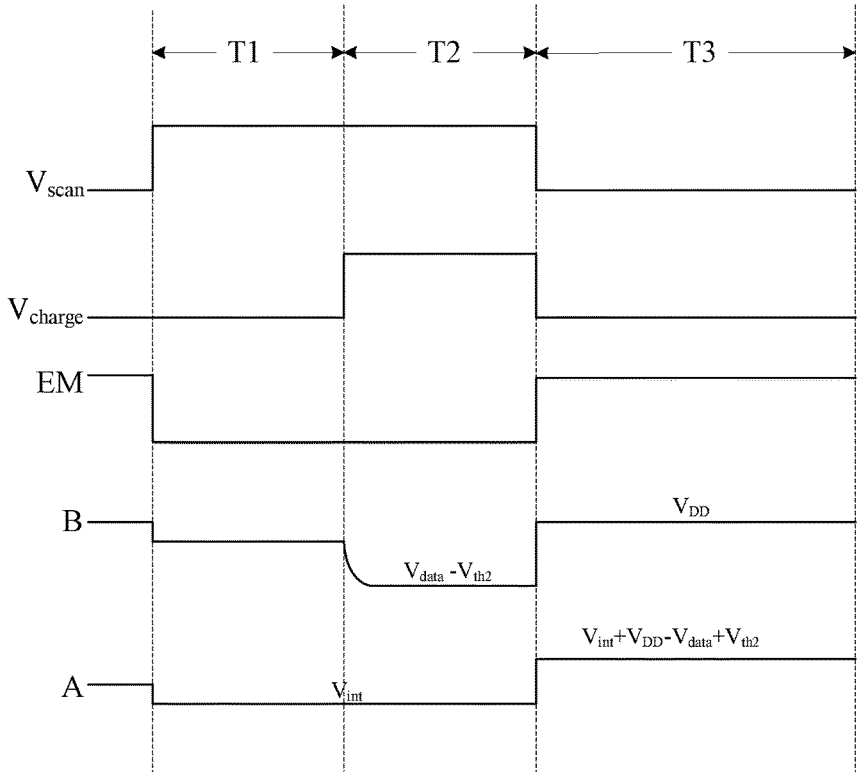
FIG. 4*b* is a circuit timing diagram for the pixel circuit of FIG. 3*b*.

The operation of the pixel circuit is described by taking the pixel circuit shown in FIG. 3*b* as an example. In the pixel circuit shown in FIG. 3*b*, the first driving transistor DT1 and the second driving transistor DT2 are P-type transistors, and all switch transistors are N-type transistors. Each of the N-type transistors turns on under the high level, and is cut off under the low level. The corresponding input timing diagram is shown in FIG. 4*b*. In particular, three phases T1, T2, and T3 in the input timing diagram shown in FIG. 4*b* are selected.

In the phase T1, $V_{scan}=1$, $V_{charge}=0$, and EM=0. Accordingly, the first switch transistor T1 is in the on-state, while the second switch transistor T2, the third switch transistor T3 and the fourth switch transistor T4 are in the off-state. The initialization signal $V_{int}$ is supplied to the first node A via the first switch transistor T1 in the on-state. Therefore, in this phase, the voltage of the first node A is $V_{int}$, and the voltage of the second node B decreases as the voltage of the first node A decreases.

In the phase T2, $V_{scan}=1$, $V_{charge}=1$, and EM=0. Accordingly, the first switch transistor T1 and the second switch transistor T2 are in the on-state, while the third switch transistor T3 and the fourth switch transistor T4 are in the off-state. The initialization signal $V_{int}$ is supplied to the first node A via the first switch transistor T1 in the on-state. Since the second switch transistor T2 turns on, the capacitor C starts to discharge via the second driving transistor DT2. Until the source voltage of the second driving transistor DT2 is $V_{data}-V_{th2}$, i.e., the second driving transistor DT2 is in the subthreshold state, the capacitor C stops discharging. In this phase, the voltage of the first node A is still $V_{int}$, and the voltage of the second node B gradually decreases to $V_{data}-V_{th2}$.

In the phase T3, $V_{scan}=0$, $V_{charge}=0$, and EM=1. The first switch transistor T1 and the second switch transistor T2 are in the off-state, while the third switch transistor T3 and the fourth switch transistor T4 are in the on-state. In this phase, since the third switch transistor T3 turns on, the voltage of the second node B changes from $V_{data}-V_{th2}$ in the previous phase to the voltage $V_{DD}$ of the first reference voltage line VDD. According to the principle of charge conservation in the capacitor, the voltage of the first node A changes from $V_{int}$ in the previous phase to $V_{int}+V_{DD}-(V_{data}-V_{th2})$. Therefore, in this phase, the gate of the first driving transistor DT1 has a voltage which is kept at $V_{int}+V_{DD}-(V_{data}-V_{th2})$, the source voltage of the first driving transistor DT1 is $V_{DD}$, and the first driving transistor DT1 operates in the saturation state. According to the saturation state current characteristics, the operating current $I_{OLED}$ which runs through the first driving transistor DT1 and drives the OLED to emit light satisfies the following formula: $I_{OLED}=K(V_{gs}-V_{th1})^2=K[V_{int}+V_{DD}-(V_{data}-V_{th2})-V_{DD}-V_{th1}]^2=K(V_{int}-V_{data}+V_{th2}-V_{th1})^2$, wherein K is the structural parameter. K has a relatively stable value in identical structures, and thus can be deemed as a constant. Since the threshold voltage $V_{th2}$ of the second driving transistor DT2 equals to the threshold voltage $V_{th1}$ of the first driving transistor DT1, the operating current $I_{OLED}=K(V_{int}-V_{data})^2$. As can be seen, the operating current $I_{OLED}$ of the OLED is no longer affected by the threshold voltage $V_{th1}$ of the first driving transistor DT1, and is independent from the voltage $V_{DD}$ of the first reference voltage line VDD and only dependent on the voltage of the data signal $V_{data}$ and the initialization signal $V_{int}$. Therefore, the effect of the drift and IR drop of the threshold voltage $V_{th1}$ of the first driving transistor DT1 (due to process factors and long-time operation) on the operating current $I_{OLED}$ of the light emitter D1 is completely eliminated, which decreases non-uniformity of panel display.

Figure 5:
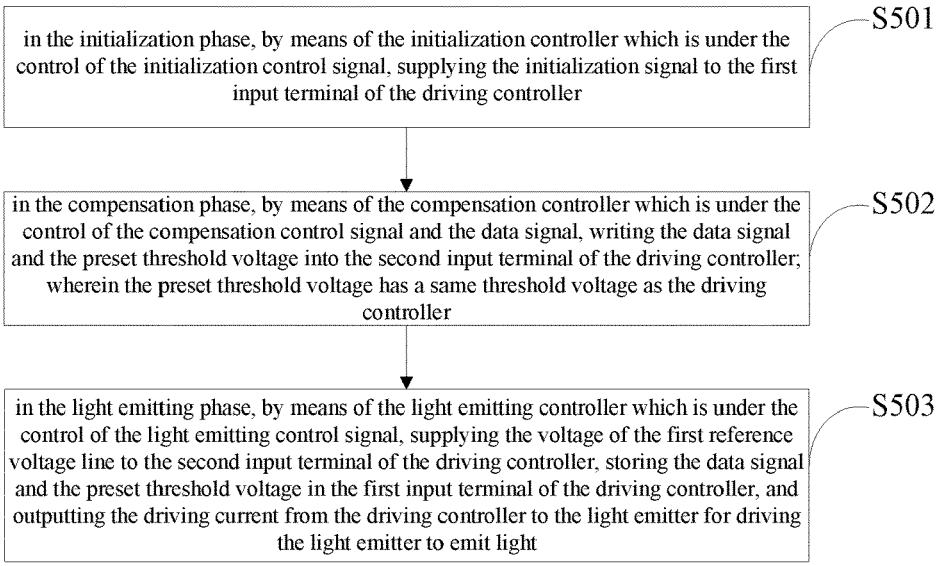
FIG. 5 is a flow chart illustrating a method for driving a pixel circuit in an embodiment of the present invention.

On basis of the same inventive concept, an embodiment of the present invention further provides a method for driving the above pixel circuit. As shown in FIG. 5, the driving method comprises:

S501, in the initialization phase, by means of the initialization controller which is under the control of the initialization control signal, supplying the initialization signal to the first input terminal of the driving controller;

S502, in the compensation phase, by means of the compensation controller which is under the control of the compensation control signal and the data signal, writing the data signal and the preset threshold voltage into the second input terminal of the driving controller; wherein the preset threshold voltage has a same threshold voltage as the driving controller; and S503, in the light emitting phase, by means of the light emitting controller which is under the control of the light emitting control signal, supplying the voltage of the first reference voltage line to the second input terminal of the driving controller, storing the data signal and the preset threshold voltage in the first input terminal of the driving controller, and outputting the driving current from the driving controller to the light emitter for driving the light emitter to emit light.

On basis of the same inventive concept, an embodiment of the present invention further provides an OLED display panel, which comprises any pixel circuit in the above embodiments. The OLED display panel solves the problem with a principle similar with the foregoing pixel circuit. Therefore, as for implementations of the pixel circuit in the OLED display panel, reference can be made to the above embodiments of the pixel circuit, which are not repeated for simplicity.

On basis of the same inventive concept, an embodiment of the present invention further provides a display device, which comprises the above OLED display panel. The display device can be a monitor, a mobile phone, a TV set, a notebook computer, an electric paper, a digital photo frame, a navigator, an all-in-one machine, or the like. The display device further comprises other essential parts, but these parts are known for the person with ordinary skill in the art and thus are not repeated herein for simplicity. These parts shall not be read as limitations to the present invention.

In the pixel circuit, the driving method, the organic electroluminescent display panel, and the display device of the above embodiments, the pixel circuit comprises the driving controller, the light emitter, the light emitting controller, the initialization controller, and the compensation controller. These modules cooperate with one another, and by using the preset threshold voltage which is written by the compensation controller and has a same threshold voltage as the driving controller, the pixel circuit can compensate the drift of the threshold voltage of the driving controller. Therefore, during emitting light to display, the driving current by which the driving controller drives the light emitter to emit light is only dependent on the voltage of the data signal and the voltage of the initialization signal, and independent on the threshold voltage of the driving controller, thus preventing the threshold voltage of the driving controller from affecting the light emitter. Namely, when different pixel units are supplied with an identical data signal, images of identical brightness can be obtained, which improves uniformity of image brightness in the display region of the display device.

Apparently, the person with ordinary skill in the art can make various modifications and variations to the present invention without departing from the spirit and the scope of the present invention. In this way, provided that these modifications and variations of the present invention belong to the scopes of the claims of the present invention and the equivalent technologies thereof, the present invention also intends to encompass these modifications and variations.

What is claimed is:

1. A pixel circuit, comprising a driving controller, a light emitter, a light emitting controller, an initialization controller, and a compensation controller, wherein the driving controller comprises a first input terminal which is connected with an output terminal of the initialization controller; a second input terminal which is connected with an output terminal of the compensation controller and a first output terminal of the light emitting controller; a third input terminal which is connected with a first input terminal of the light emitting controller and a first reference voltage line; and an output terminal which is connected with a second input terminal of the light emitting controller, and the driving controller is configured to supply a driving current to the light emitter for driving the light emitter to emit light;

wherein the initialization controller comprises a control terminal which is configured to receive an initialization control signal; an input terminal which is configured to receive an initialization signal; and an output terminal which is connected with the first input terminal of the driving controller, and in an initialization phase, the initialization controller is configured to, under the control of the initialization control signal, supply the initialization signal to the driving controller;

wherein the compensation controller comprises a first control terminal which is configured to receive a compensation control signal; a second control terminal which is configured to receive a data signal; an output terminal which is connected with the second input terminal of the driving controller and the first output terminal of the light emitting controller; and an input terminal which is connected with a second reference voltage line, and in the compensation phase, the compensation controller is configured to, under the control of the compensation control signal and the data signal, write the data signal and a preset threshold voltage into the driving controller, wherein the preset threshold voltage has a same threshold voltage as the driving controller to compensate the drift of the threshold voltage of the driving controller; and wherein the light emitting controller comprises a first input terminal which is connected with the third input terminal of the driving controller and the first reference voltage line; a control terminal which is configured to receive a light emitting control signal; the second input terminal which is connected with an output terminal of the driving controller; the first output terminal which is connected with the second input terminal of the driving controller and the output terminal of the compensation controller; and a second output terminal which is connected with a terminal of the light emitter, and the other terminal of the light emitter is connected with a third reference voltage line, and in a light emitting phase, the light emitting controller is configured to, under the control of the light emitting control signal, supply a voltage of the first reference voltage line to input terminal of the driving controller, store the data signal and the preset threshold voltage in another input terminal of the driving controller, and apply the driving current from the driving controller to the light emitter for driving the light emitter to emit light.

2. The pixel circuit of claim 1, wherein in the light emitting phase, the light emitting controller is configured to, under the control of the light emitting control signal, supply the voltage of the first reference voltage line to the second input terminal of the driving controller, and store the data signal and the preset threshold voltage in the first input terminal of the driving controller.

3. The pixel circuit of claim 1, wherein the driving controller comprises a first driving transistor and capacitor, wherein the first driving transistor comprises a gate, which is the first input terminal of the driving controller; a source, which is the third input terminal of the driving controller; and a drain, which is the output terminal of the driving controller, and the first driving transistor has a threshold voltage equal to that of the driving controller; and wherein the capacitor comprises a first terminal which is connected with the gate of the first driving transistor, and a second terminal which is the second input terminal of the driving controller.

4. The pixel circuit of claim 1, wherein the initialization controller comprises a first switch transistor, wherein the first switch transistor comprises a gate, which is the control terminal of the initialization controller; a source, which is the input terminal of the initialization controller; and a drain, which is the output terminal of the initialization controller.

5. The pixel circuit of claim 4, wherein the compensation controller comprises a second switch transistor and a second driving transistor, wherein the second switch transistor comprises a gate, which is the first control terminal of the compensation controller; a drain, which is the input terminal of the compensation controller; and a source which is connected with the drain of the second driving transistor; and wherein the second driving transistor comprises a gate, which is the second control terminal of the compensation controller; and a source, which is the output terminal of the compensation controller, wherein the second driving transistor has a threshold voltage equal to the preset threshold voltage.

6. The pixel circuit of claim 5, wherein the second driving transistor has a size and shape identical to that of the first driving transistor.

7. The pixel circuit of claim 6, wherein the second driving transistor is arranged close to the first driving transistor.

8. The pixel circuit of claim 5, wherein the light emitting controller comprises a third switch transistor and a fourth switch transistor, wherein the third switch transistor comprises a gate, which is the control terminal of the light emitting controller; a source, which is the first input terminal of the light emitting controller; and a drain, which is the first output terminal of the light emitting controller; and wherein the fourth switch transistor comprises a gate, which is the control terminal of the light emitting controller; a source, which is the second input terminal of the light emitting controller; and a drain, which is the second output terminal of the light emitting controller.

9. The pixel circuit of claim 8, wherein the first switch transistor, the second switch transistor, the third switch transistor, and the fourth switch transistor are N-type transistors.

10. A method for driving a pixel circuit that comprises a driving controller, a light emitter, a light emitting controller, an initialization controller, and a compensation controller, wherein the driving controller comprises a first input terminal which is connected with an output terminal of the initialization controller; a second input terminal which is connected with an output terminal of the compensation controller and a first output terminal of the light emitting controller; a third input terminal which is connected with a first input terminal of the light emitting controller and a first reference voltage line; and an output terminal which is connected with a second input terminal of the light emitting controller, and the driving controller is configured to supply a driving current to the light emitter for driving the light emitter to emit light; wherein in an initialization phase, the initialization controller comprises a control terminal which is configured to receive an initialization control signal; an input terminal which is configured to receive an initialization signal; and an output terminal which is connected with the first input terminal of the driving controller, and the initialization controller is configured to, under the control of the initialization control signal, supply the initialization signal to the driving controller; wherein the compensation controller comprises a first control terminal which is configured to receive a compensation control signal; a second control terminal which is configured to receive a data signal; an output terminal which is connected with the second input terminal of the driving controller and the first output terminal of the light emitting controller; and an input terminal which is connected with a second reference voltage line, and in the compensation phase, the compensation controller is configured to, under the control of the compensation control signal and the data signal, write the data signal and a preset threshold voltage into the driving controller, wherein the preset threshold voltage has a same threshold voltage as the driving controller to compensate the drift of the threshold voltage of the driving controller; and wherein the light emitting controller comprises a first input terminal which is connected with the third input terminal of the driving controller and the first reference voltage line; a control terminal which is configured to receive a light emitting control signal; the second input terminal which is connected with an output terminal of the driving controller; the first output terminal which is connected with the second input terminal of the driving controller and the output terminal of the compensation controller; and a second output terminal which is connected with a terminal of the light emitter, and the other terminal of the light emitter is connected with a third reference voltage line, and in a light emitting phase, the light emitting controller is configured to, under the control of the light emitting control signal, supply a voltage of the first reference voltage line to an input terminal of the driving controller, store the data signal and the preset threshold voltage in another input terminal of the driving controller, and apply the driving current from the driving controller to the light emitter for driving the light emitter to emit light, the method comprising:

in the initialization phase, by means of the initialization controller which is under the control of the initialization control signal, supplying the initialization signal to the first input terminal of the driving controller;

in the compensation phase, by means of the compensation controller which is under the control of the compensation control signal and the data signal, writing the data signal and the preset threshold voltage into the second input terminal of the driving controller; wherein the preset threshold voltage has a same threshold voltage as the driving controller;

in the light emitting phase, by means of the light emitting controller which is under the control of the light emitting control signal, supplying the voltage of the first reference voltage line to the second input terminal of the driving controller, storing the data signal and the preset threshold voltage in the first input terminal of the driving controller, and outputting the driving current from the driving controller to the light emitter for driving the light emitter to emit light.

11. An organic electroluminescent display panel, comprising a pixel circuit, wherein the pixel circuit comprises a driving controller, a light emitter, a light emitting controller, an initialization controller, and a compensation controller, wherein the driving controller comprises a first input terminal which is connected with an output terminal of the initialization controller; a second input terminal which is connected with an output terminal of the compensation controller and a first output terminal of the light emitting controller; a third input terminal which is connected with a first input terminal of the light emitting controller and a first reference voltage line; and an output terminal which is connected with a second input terminal of the light emitting controller, and the driving controller is configured to supply a driving current to the light emitter for driving the light emitter to emit light;

wherein the initialization controller comprises a control terminal which is configured to receive an initialization control signal; an input terminal which is configured to receive an initialization signal; and an output terminal which is connected with the first input terminal of the driving controller, and in an initialization phase, the initialization controller is configured to, under the control of the initialization control signal, supply the initialization signal to the driving controller;

wherein the compensation controller comprises a first control terminal which is configured to receive a compensation control signal; a second control terminal which is configured to receive a data signal; an output terminal which is connected with the second input terminal of the driving controller and the first output terminal of the light emitting controller; and an input terminal which is connected with a second reference voltage line, and in the compensation phase, the compensation controller is configured to, under the control of the compensation control signal and the data signal, write the data signal and a preset threshold voltage into the driving controller, wherein the preset threshold voltage has a same threshold voltage as the driving controller to compensate the drift of the threshold voltage of the driving controller; and wherein the light emitting controller comprises a first input terminal which is connected with the third input terminal of the driving controller and the first reference voltage line; a control terminal which is configured to receive a light emitting control signal; the second input terminal which is connected with an output terminal of the driving controller; the first output terminal which is connected with the second input terminal of the driving controller and the output terminal of the compensation controller; and a second output terminal which is connected with a terminal of the light emitter, and the other terminal of the light emitter is connected with a third reference voltage line, and in a light emitting phase, the light emitting controller is configured to, under the control of the light emitting control signal, supply a voltage of the first reference voltage line to an input terminal of the driving controller, store the data signal and the preset threshold voltage in another input terminal of the driving controller, and apply the driving current from the driving controller to the light emitter for driving the light emitter to emit light.

12. A display device, comprising the organic electroluminescent display panel of claim 11.

13. The pixel circuit of claim 8, wherein the first switch transistor, the second switch transistor, the third switch transistor, and the fourth switch transistor are P-type transistors.

14. The organic electroluminescent display panel of claim 11, wherein in the light emitting phase, the light emitting controller is configured to, under the control of the light emitting control signal, supply the voltage of the first reference voltage line to the second input terminal of the driving controller, and store the data signal and the preset threshold voltage in the first input terminal of the driving controller.

15. The organic electroluminescent display panel of claim 11, wherein the driving controller comprises a first driving transistor and capacitor, wherein the first driving transistor comprises a gate, which is the first input terminal of the driving controller; a source, which is the third input terminal of the driving controller; and a drain, which is the output terminal of the driving controller, and the first driving transistor has a threshold voltage equal to that of the driving controller; and wherein the capacitor comprises a first terminal which is connected with the gate of the first driving transistor, and a second terminal which is the second input terminal of the driving controller.

16. The organic electroluminescent display panel of claim 11, wherein the initialization controller comprises a first switch transistor, wherein the first switch transistor comprises a gate, which is the control terminal of the initialization controller; a source, which is the input terminal of the initialization controller; and a drain, which is the output terminal of the initialization controller.

17. The organic electroluminescent display panel of claim 16, wherein the compensation controller comprises a second switch transistor and a second driving transistor, wherein the second switch transistor comprises a gate, which is the first control terminal of the compensation controller; a drain, which is the input terminal of the compensation controller; and a source which is connected with the drain of the second driving transistor; and wherein the second driving transistor comprises a gate, which is the second control terminal of the compensation controller; and a source, which is the output terminal of the compensation controller, wherein the second driving transistor has a threshold voltage equal to the preset threshold voltage.

18. The organic electroluminescent display panel of claim 17, wherein the second driving transistor has a size and shape identical to that of the first driving transistor.

* * * * *